US007427967B2

(12) United States Patent
Hughes

(10) Patent No.: US 7,427,967 B2
(45) Date of Patent: Sep. 23, 2008

(54) PHASED ARRAY ANTENNA AND INTER-ELEMENT MUTUAL COUPLING CONTROL METHOD

(75) Inventor: Barry John Hughes, Malvern (GB)

(73) Assignee: Qinetiq Limited (GB)

( * ) Notice: Subject to any disclaimer, the term of this patent is extended or adjusted under 35 U.S.C. 154(b) by 0 days.

(21) Appl. No.: 10/543,745

(22) PCT Filed: Jan. 29, 2004

(86) PCT No.: PCT/GB2004/000368

§ 371 (c)(1),
(2), (4) Date: Jul. 29, 2005

(87) PCT Pub. No.: WO2004/068633

PCT Pub. Date: Aug. 12, 2004

(65) Prior Publication Data

US 2006/0164317 A1 Jul. 27, 2006

(30) Foreign Application Priority Data

Feb. 1, 2003 (GB) ..... 0302326.4
Mar. 5, 2003 (GB) ..... 0304946.7

(51) Int. Cl.
*H01Q 21/00* (2006.01)

(52) U.S. Cl. ..... 343/853; 343/841

(58) Field of Classification Search ..... 343/783, 343/841, 853

See application file for complete search history.

(56) References Cited

U.S. PATENT DOCUMENTS

| | | | | |
|---|---|---|---|---|
| 3,277,488 | A | 10/1966 | Hoffman | |
| 4,908,543 | A * | 3/1990 | Sabet-Peyman | 310/334 |
| 5,497,164 | A * | 3/1996 | Croq | 343/700 MS |
| 5,952,971 | A * | 9/1999 | Strickland | 343/700 MS |
| 5,999,211 | A * | 12/1999 | Hedges et al. | 348/144 |
| 6,069,586 | A | 5/2000 | Karlsson et al. | |
| 6,211,824 | B1 | 4/2001 | Holden et al. | |
| 2002/0101388 | A1 | 8/2002 | Ippolito | |
| 2002/0149519 | A1 * | 10/2002 | Varadan et al. | 343/700 MS |

FOREIGN PATENT DOCUMENTS

| | | |
|---|---|---|
| EP | 0 886 336 | 12/1998 |
| EP | 1 071 161 | 1/2001 |

* cited by examiner

*Primary Examiner*—Tho G Phan
(74) *Attorney, Agent, or Firm*—McDonnell Boehnen Hulbert & Berghoff LLP

(57) ABSTRACT

A phased array antenna (400) comprises a first array element (402) and second array element (404) and a dielectric separator (408). Each of the first and second array elements (402, 404) is a detection element and or an emitter element. The dielectric separator (408) is located between the first and second array elements (402, 404) and within a path of an inter-element mutual coupling (IMC) signal between the first array element (402) and the second array element (404).

14 Claims, 7 Drawing Sheets

PHASED ARRAY ANTENNA AND INTER-ELEMENT MUTUAL COUPLING CONTROL METHOD

This invention relates to a phased array antenna and mutual coupling control method. More particularly, but not exclusively, the invention relates to a mutual coupling control device and method that employs phase control of mutual coupling.

A phased array antenna (PAA) typically comprises a number of array elements that are distributed in a predetermined, typically uniform pattern or in a randomly distributed pattern. PAAs can be either linear or planar or conformal in nature.

In transmit mode a plane wavefront (102) is produced from spherical wavefronts (103*a-c*) which propagate from the array elements. The plane wavefront is steered by applying complex (phase and amplitude) weights to the individual input signals applied at each array element (104*a-c*), see for example FIG. 1.

In receive mode complex weights are applied to signals received at the individual array elements and signal processing is then applied to analyse a combined received signal.

Referring now to FIGS. 2 and 3, these show sum (202, 302) and difference (204, 304) beams for steered array beams steered to 0° and 30° from boresight respectively. Thus, PAAs enable beams to be steered without the need to physically move the array or its elements.

PAAs exhibit high beam agility compared to mechanically steered antennas as they do not suffer from the inertial limitations that are associated with mechanically steered antennas, as PAAs are steered by adjustment of amplitude and or phase input signals using complex weights. Also, phased array antennas are advantageous over mechanically steered antennas as they offer a digital beamforming capability which allows the tracking of multiple targets, for example air traffic control, combined with adaptive nulling in order to suppress interference effects and also to correct for other effects such as, for example, the presence of a radome.

PAA's have a number of limitations associated with them, for example grating lobes which limit the practical field of regard (FOR) of an array. Grating lobes are additional major beams which arise from using too large inter-element array spacings for a maximum scan angle range and of a given frequency. Grating lobes also receive input signals from a target, leading to ambiguity in the target return direction. As the inter-array element spacings increase the grating lobes become apparent at scan angles closer to the boresight direction, thus further reducing the array's operational FOR.

A further limitation of PAA's is inter-element mutual coupling (IMC). This is an electromagnetic (EM) interference effect between array elements. This effect leads to distorted radiation patterns for each array element when embedded in an array. The effect IMC has on a particular element's embedded radiation pattern is dependent upon the position (EM environment) of that array element relative to all other array elements. The resulting diversity of embedded radiation patterns in PAA's leads to unwanted beam steering inaccuracies.

Consider two adjacent array elements, EM fields emitted from a first element are incident upon a second element which need not be operating or radiating itself. The second element can affect the fields from the first element and also absorb and re-radiate them, so that electromagnetic fields from the second element are incident on the first element. The first element can then also absorb and re-radiate the fields from the second element. This process continues until a steady state is achieved. Hence, when a signal is applied to the first element both elements can radiate, and the radiation from each can be the result of several interactions. The nature of this interference, and therefore the distortion of the embedded element pattern, depends on the amplitude and the phase of the total coupling between the elements.

The amplitude and phase of the IMC signal affecting a particular array element, and hence its embedded radiation patterns, depends upon it's position relative to all of the other array elements.

Thus, increasing the inter-element spacing of an array is desirable in order to reduce the magnitude of IMC between array elements. In doing so it is possible to reduce the amount of embedded radiation pattern distortion throughout the array. However, as detailed hereinbefore, increasing the inter-element array spacing results in a reduction of operational FOR due to grating lobes.

Conversely, reducing inter-element array spacing increases the operational FOR of a PAA But also leads to an increase in the effect of IMC.

In the past, attempts have been made to reduce the effect of IMC by reducing the amplitude component of the signal between array elements. These include near field containment in which alterations are made to the array structure in an attempt to prevent the near field from one array element coupling to an adjacent array element. Near field containment typically reduces the amplitude of IMC by use of thin metal plates, baffles, or fences placed periodically between array elements. These structures are designed to act as sinks for the near field.

Another technique is to use random sparsely populated arrays. These arrays exploit the fact that using large inter-element array spacings can lead to a reduction in the effect of IMC. Grating lobe limitations as a result of increased array spacings are avoided by the random distribution of array elements. A consequence of using this type of array is that they need to be large, typically containing over 100 elements.

Mathematical techniques have also been employed to compensate for the effects of IMC. Such techniques include the matrix inversion method in which complex weights are determined from the measurement of IMC signals between array elements. These complex weights are then applied to a distorted signal in such a way that the resultant signal is equivalent to one that would have been transmitted or received had no IMC been present. This technique has the disadvantage of requiring IMC calibration measurements for each array element to be made. Also the application of complex weights in this method is extremely processor intensive which is undesirable in an already processor intensive environment.

According to a first aspect of the present invention there is provided a phased array antenna comprising a first array element and a second array element and a dielectric separator, the dielectric separator being interposed between the first and second array elements within a path of an inter-element mutual coupling (IMC) signal between the first and second array elements.

The dielectric separator provides a means of modifying the phase component of the signal received at the second array element that has arisen due to IMC resulting from the operation of the first array element. This arrangement of array elements and dielectric separators allows the control of the effect of IMC on embedded element radiation patterns. It also offers a relaxation in the design constraints placed on array design in terms of grating lobes and the operation FOR of an array. It has been appreciated and exploited that the phase relationship between mutually coupled array elements is more influential in distorting the embedded radiation patterns of array elements than the amplitude. The control of this phase relationship gives more control over the effects of IMC on embedded radiation patterns than prior art near-field techniques. This arrangement also allows the relaxation in the design constraints placed on array design in terms of minimising grating lobes whilst increasing the operational FOR of an array. This arrangement also benefits array design in that it provides to some extent the ability to reduce the inter-element array spacing whilst minimising the effects of IMC. This is advantageous as it provides the possibility of smaller arrays with greater operational FOR performance by suppressing the earlier discussed problems associated with element spacings and grating lobes.

Either, or both, of first and second array elements may be an emitter element and/or a detector element.

The dielectric separator may be any one, or combination of the following: a plain flat wall, an annular wall, a plurality of conjoined plain flat walls or a plurality of conjoined annular walls. Any of these structures may include walls that have a particular profile and or are made using varying dielectric constants. Thus, the separator separates an individual array element from another individual array element or separates a single array element or a plurality of array elements from a plurality of array elements.

The dielectric separator may have a dielectric constant, $\epsilon_r$, in the range 2-40. The dielectric separator may have a dielectric constant of between 3 and 12. The dielectric separator may have a dielectric constant of approximately 4.

The dielectric separator may have a combination of dielectric constant and width that is determined in order to reduce, ideally minimise, the effect of IMC between the first and second array elements. By "width" we mean the path length of the separator through which radiation passes. By selecting an appropriate combination of material dielectric constant and width of separator the phase component of IMC between array elements can be controlled such that distortion to the embedded radiation patterns is controlled.

The dielectric separator may be arranged to increase or decrease the electrical path length between the first and second array elements, for example, by embedding the array in a material of variable dielectric constant which is >1. The dielectric separator may be arranged to control a phase component of the IMC signal so as to influence embedded radiation patterns of the first and second array elements.

The array may comprise a two dimensional array of array elements, a linear array of array elements or a conformal array of array elements. All of the array elements may be substantially in a single plane. The array elements may be arranged in a grid, for example a rectangular or square grid. The array elements may be distributed in any one of the following patterns: a hexagonal pattern, a staggered or radial circular pattern. Each array element may be separated from at least one adjacent array element by a respective dielectric separator. The respective dielectric separators may be discrete or may be formed as a part of a larger, continuous portion of dielectric, such as, for example, a grid of dielectric, with the array elements located in spaces bounded by regions of the grid. At least one of the first and second array elements may be completely surrounded by a dielectric separator. Differing portions of the dielectric separator, or different dielectric separators, may have different thicknesses and/or relative permitivitties. Thus, a two-dimensional phased array antenna can have dielectric separators between array elements that are tuned to adjacent, possibly inequivalent, array elements. Alternatively, there may be grid of dielectric separators interposed between array elements of the two dimensional array.

According to a second aspect of the present invention there is provided a method of reducing the effect of IMC between a first array element and a second array element spaced apart from the first array element comprising: interposing a dielectric separator in an electromagnetic path between the first array element and the second array element.

The method may comprise controlling a phase component of an IMC signal by use of the dielectric separator.

It will be appreciated that the use of the term "array element" encompasses both detection and/or emitter elements due to the theory of reciprocity of electromagnetic radiation.

According to a third aspect of the present invention there is provided a method of improving the performance of a phased array antenna comprising the steps of:

i) determining the degree of IMC between first and second array elements;

ii) optimising a combination of at least two of the following: dielectric separator width, profile, and dielectric constant: so as to reduce control said mutual coupling;

iii) producing a dielectric separator having a width, profile, and/or dielectric constant substantially equal to those optimised in step (ii); and iv) interposing the dielectric separator between the first and second array elements.

The method may comprise controlling a phase component of an IMC signal by use of the dielectric separator.

It will be appreciated that the use of the term "array element" encompasses both detection and/or emitter elements due to the theory of reciprocity of electromagnetic radiation.

The invention will now be described, by way of example only, with reference to the accompanying drawings, in which.

Figure 1:
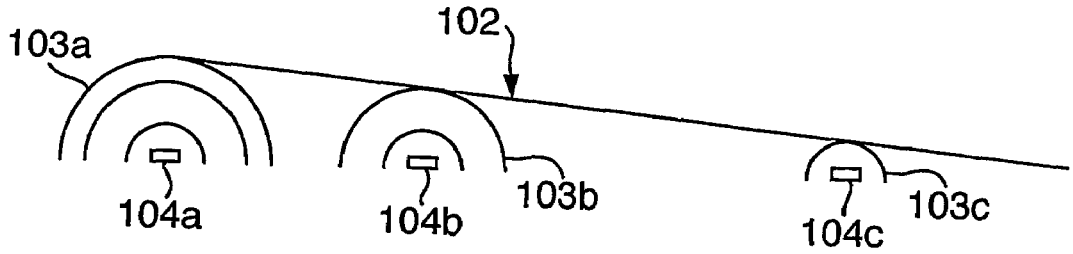
FIG. 1 is a representation of a plane wavefront generated from a plurality of output spherical wavefronts using a phased array antenna (PAA)
Figure 2:
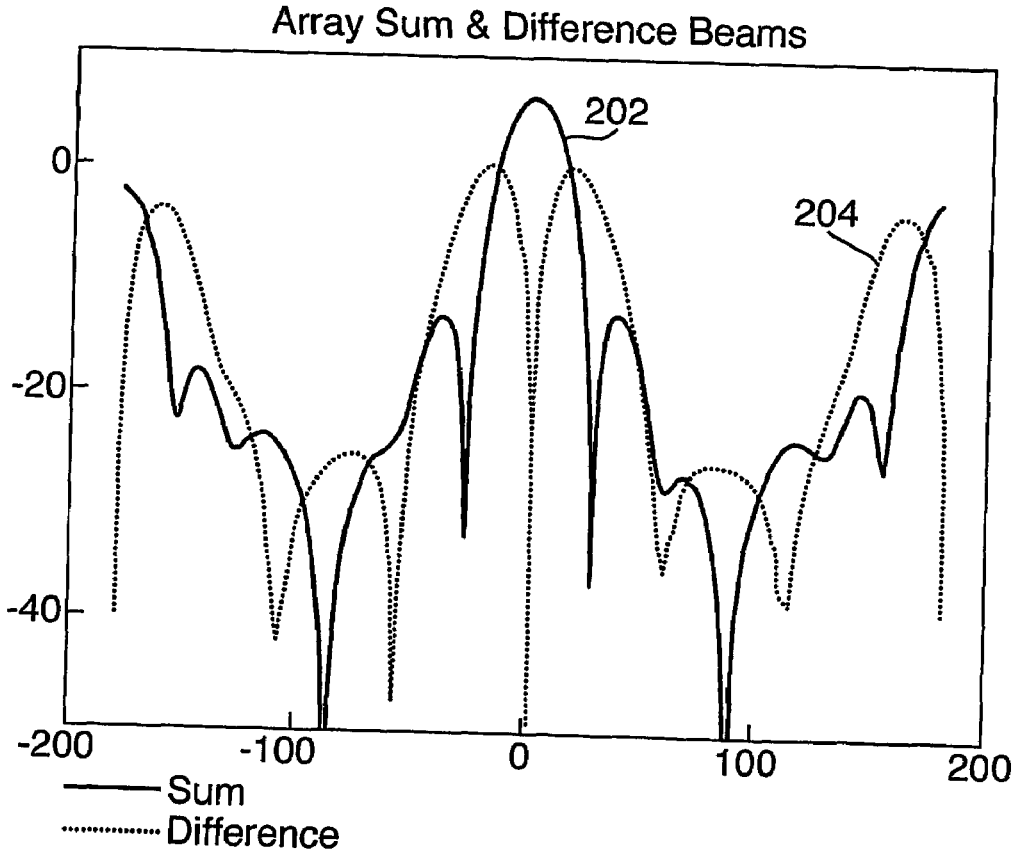
FIG. 2 is a plot of sum and difference beam intensity for a PAA steered to boresight (θ=0°) for a principal plane.
Figure 3:
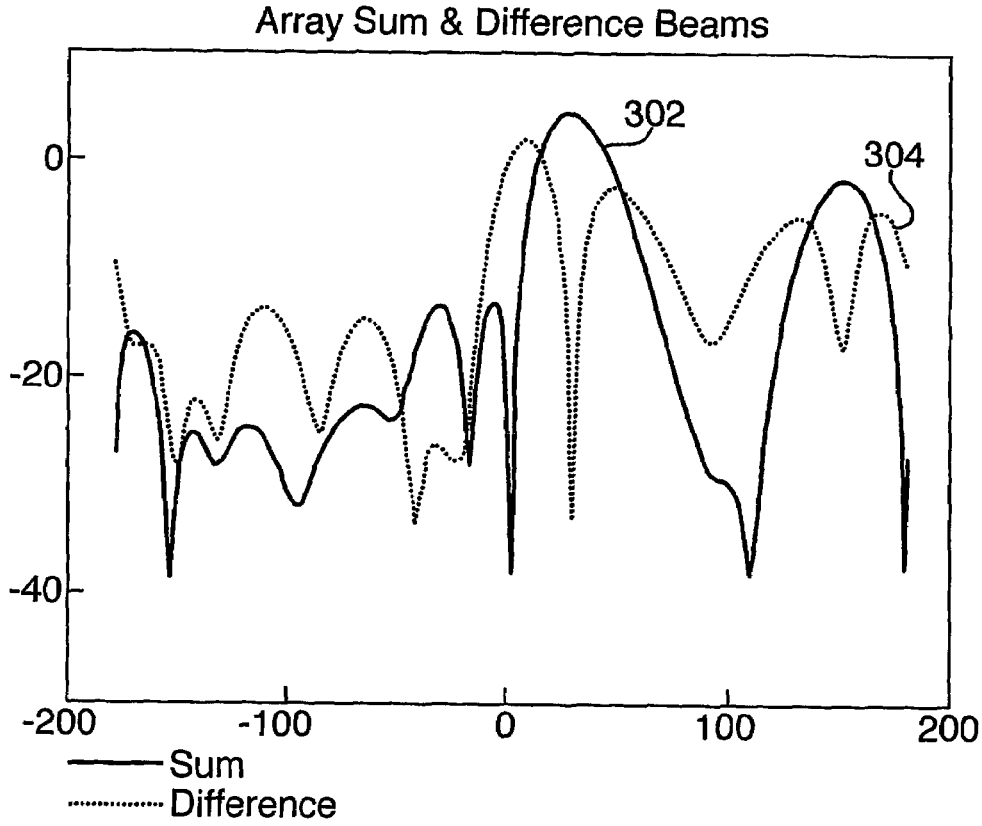
FIG. 3 is a plot of sum and difference beam intensity for a PAA steered to 30° off boresight (θ=30°) for a principal plane.
Figure 4:
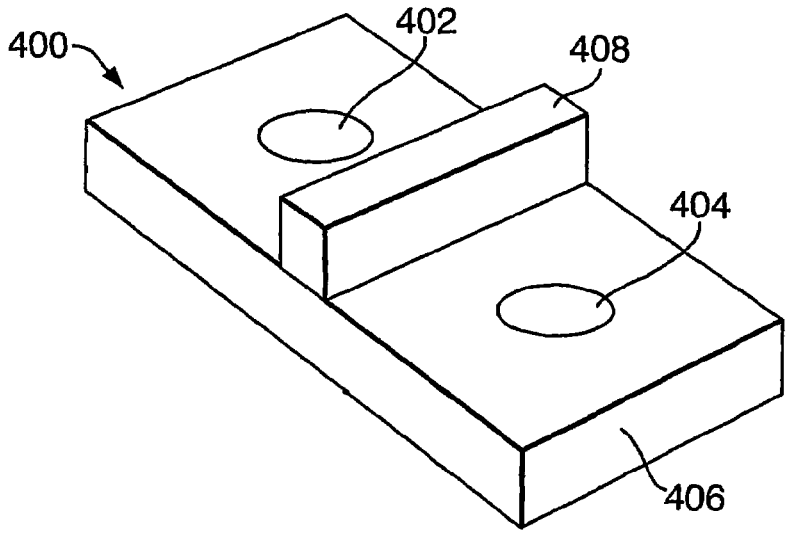
FIG. 4 is a schematic perspective representation of a first embodiment of a PAA according to at least an aspect of the present invention.
Figure 5:
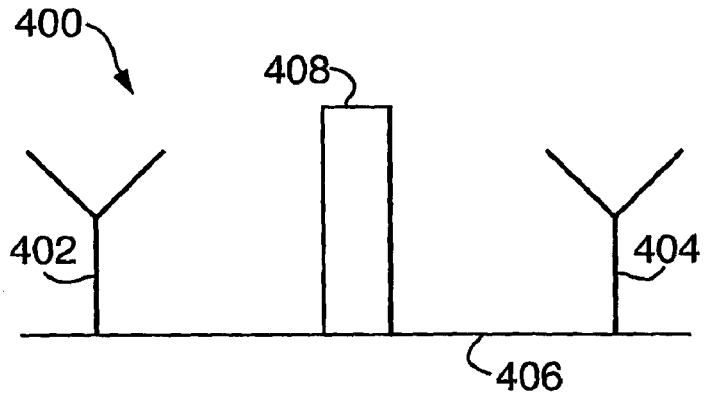
FIG. 5 is a schematic side view of the PAA of FIG. 4.
Figure 5A:
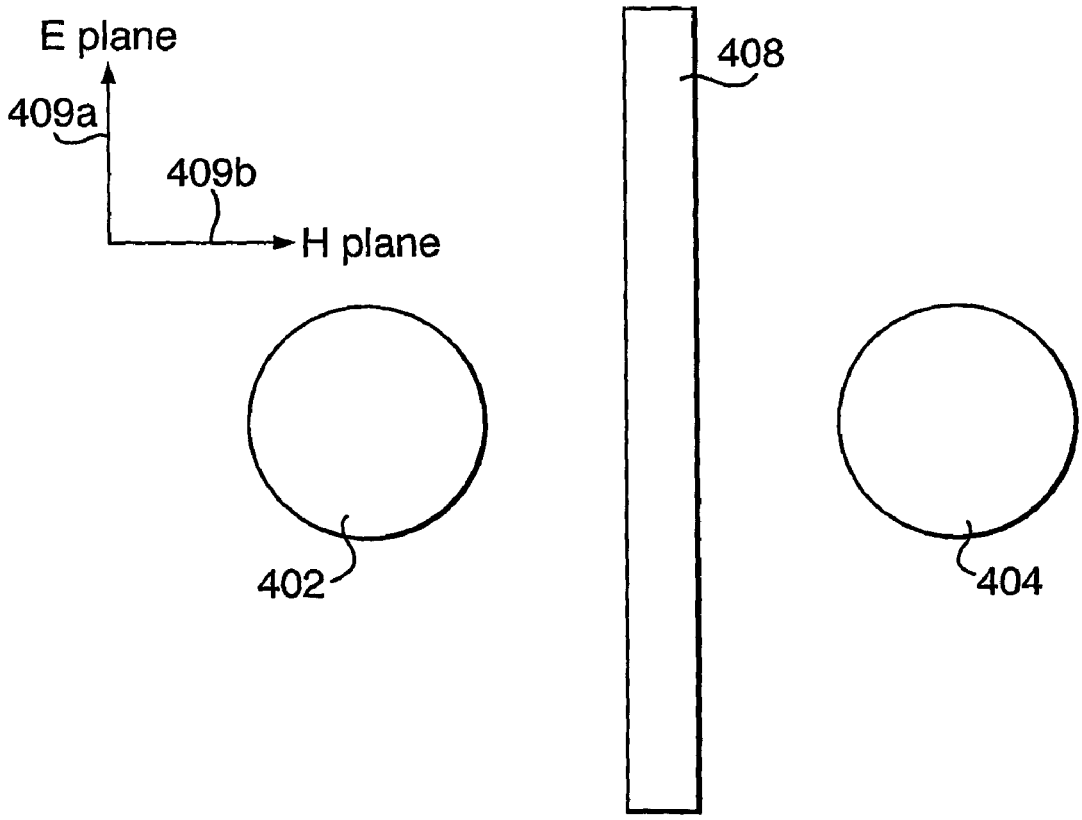
Figure 6:
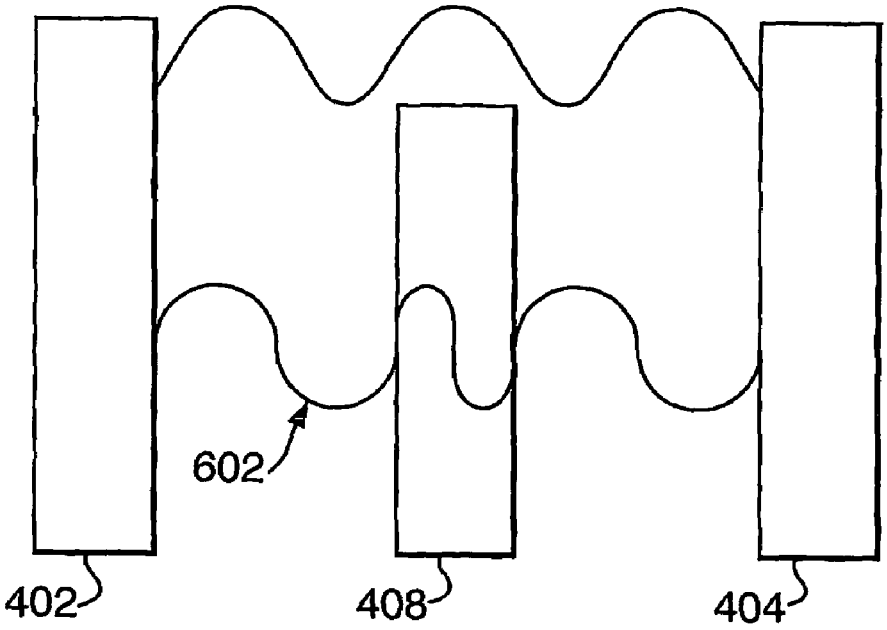
Figure 7:
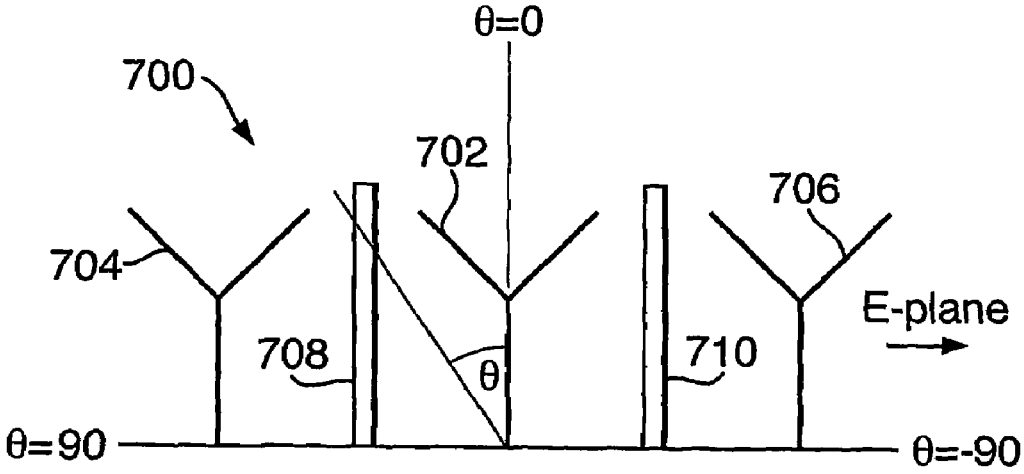
Figure 8:
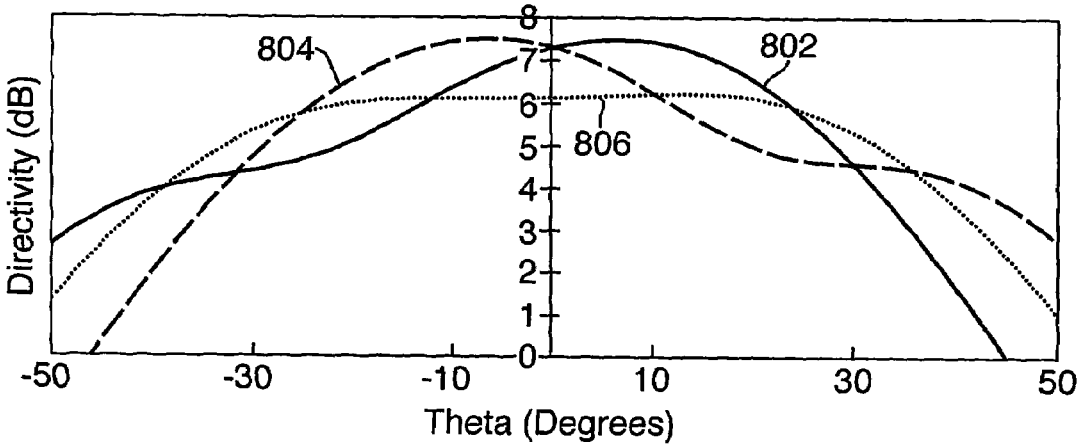
Figure 9:
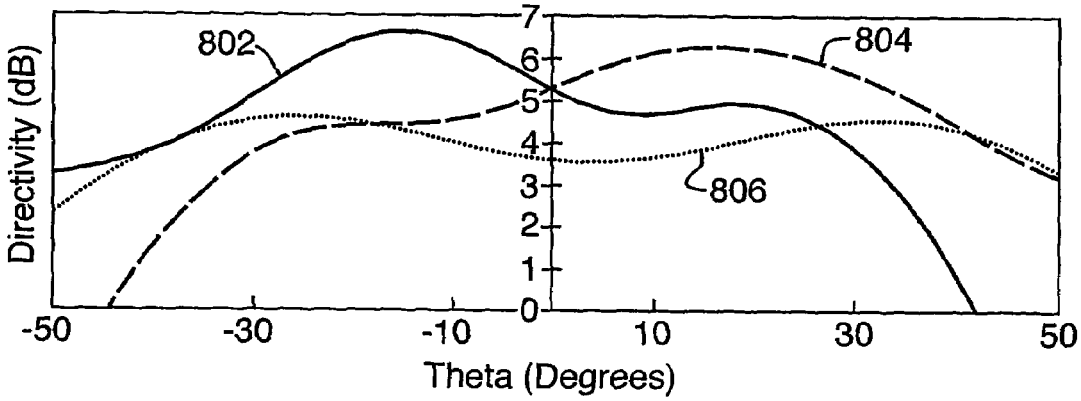
Figure 10:
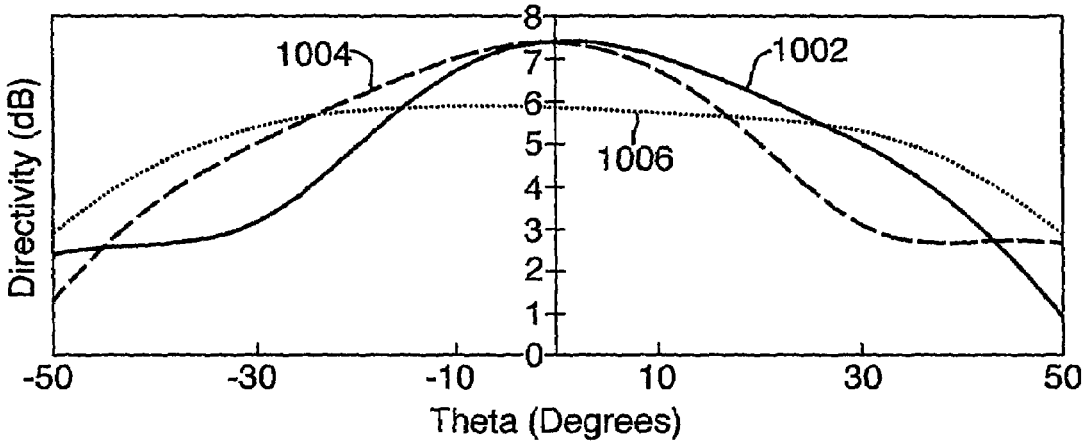
Figure 12:
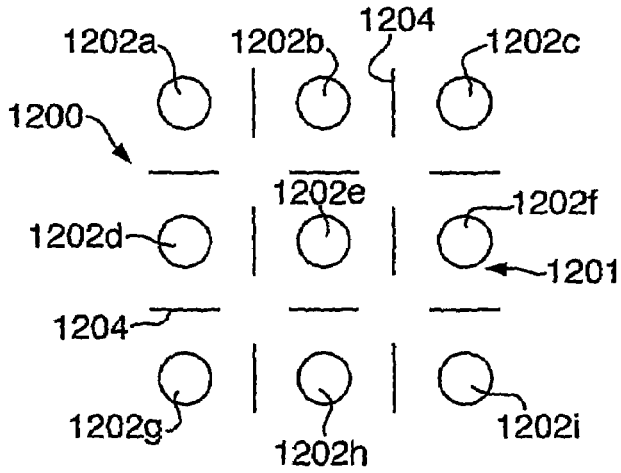
Figure 11:
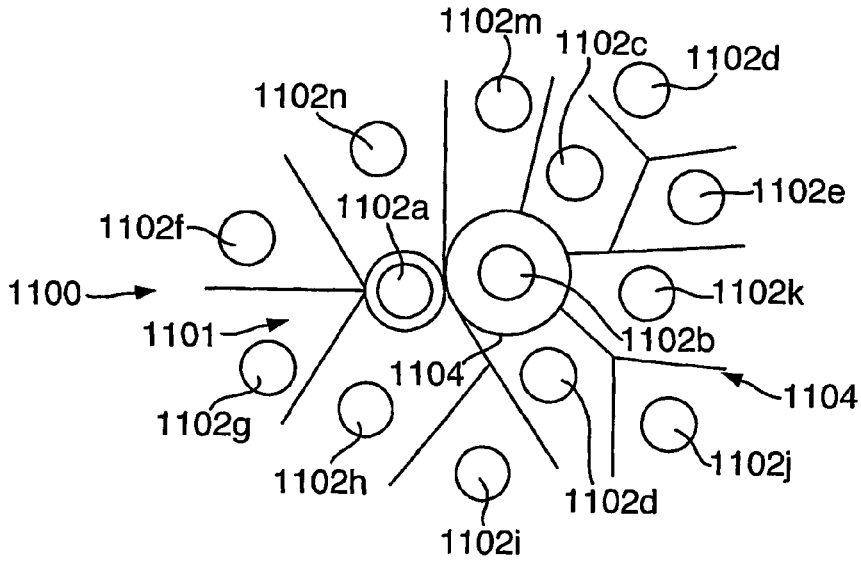
Figure 11A:
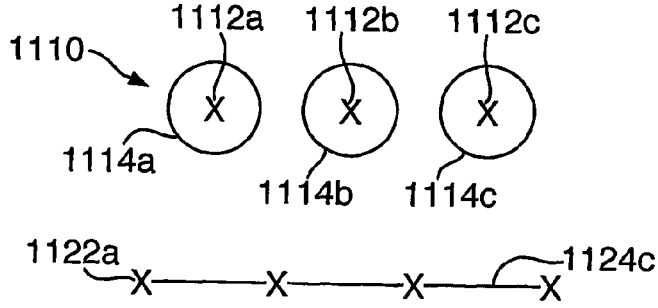
Figure 11B:
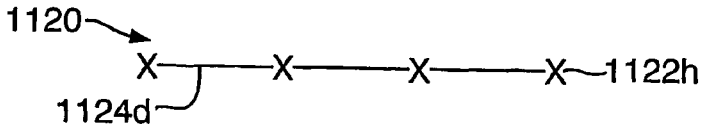
Figure 11C:
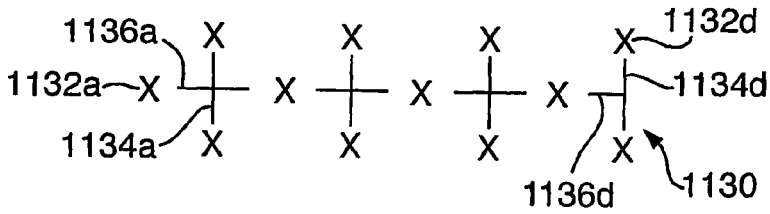

FIG. 5*a* is a schematic partial plan view of the PAA of FIGS. 4 and 5 showing the alignment of radiated H and E vectors for radiated fields;

FIG. 6 is a schematic view of the propagation of radiated fields through a dielectric separator of the PAA of FIGS. 4 and 5;

FIG. 7 is a schematic side view of a second, alternative embodiment of a PAA according to the present invention;

FIG. 8 is a plot of embedded radiation patterns in the H vector direction for each of the array elements of the PAA of FIG. 7 with no dielectric separator;

FIG. 9 is a plot of embedded radiation patterns in the H vector direction for each of the array elements of the PAA of FIG. 6 with a dielectric separator of $\epsilon_r$=9.3;

FIG. 10 is a plot of embedded radiation patterns in the H vector direction for each of the array elements of the PAA of FIG. 6 with a dielectric separator of $\epsilon_r$=4.0;

FIGS. 11 to 11*c* are schematic diagrams of embodiments of possible two dimensional arrays of a PAA according to at least an aspect of the present invention; and FIG. 12 is a schematic diagram of a second embodiment of a two dimensional array of a PAA according to at least an aspect of the present invention.

Referring now to FIGS. 4 and 5, a first embodiment of a phased array antenna 400 comprises two circular patch array elements 402, 404, supported on a dielectric substrate 406 and a dielectric separator 408 interposed between the array elements 402, 404. This arrangement results in a radiated E vector 409*a* that is aligned parallel to the dielectric separator 408 and a radiated H vector 409*b* that is orthogonal to the dielectric separator 408. It will be appreciated that the array elements 402, 404 need not be circular patch array elements but may be slot array elements or indeed non-planar array elements, for example dipoles.

Feed structures and adaptive beam forming control circuitry have been omitted for clarity.

The array elements may be detector elements and/or emitter elements depending upon the application of the phased array antenna.

The dielectric separator 408 is typically made of a material having a dielectric constant in the range of between 3 and 10, such materials include for example, Duroid RT 5880 $\epsilon_r$=2.2, Epoxy Kevlar $\epsilon_r$=3.6, FR4 Epoxy $\epsilon_r$=4.4, Glass $\epsilon_r$=5.5, Mica $\epsilon_r$=6.0, Alumina $\epsilon_r$=9.2 and Gallium Arsenide $\epsilon_r$=12.9.

The use of a the dielectric separator 408 results in the electrical distance between the adjacent elements 402, 404 being modified, and hence the phase component of IMC, as the electrical length in different media varies in proportion to:

$$\frac{1}{\sqrt{\varepsilon_r}}$$

Where:

$\epsilon_r$ is the relative permittivity of the dielectric separator.

This is because the speed of light in the dielectric separator 408 varies as:

$$c' = \frac{1}{\sqrt{\varepsilon_0 \varepsilon_r \mu_0 \mu_r}}$$

Where:

c' is the speed of light in the dielectric separator;

$\mu_r$ is the relative permeability of the dielectric separator;

$\mu_0$ is the permeability of free space; and $\epsilon_r$ is the permittivity of free space.

The relative permeability of most dielectrics is close to that of vacuum and therefore it is the variation in the relative permittivity that dominates the change in the speed of light when traversing a boundary between two materials having different relative permittivites As the frequency of light is invariant irrespective of media it is the wavelength of the radiated signal, λ, which varies to accommodate the change in the speed of light upon traversing a boundary between a first medium, typically air or vacuum, and the dielectric separator 408. Thus, the wavelength of IMC signal is effectively shortened upon entering a second medium, having a relative permittivity $\epsilon_{r2}$, from a first medium, having a relative permittivity $\epsilon_{r1}$, where $\epsilon_{r2}>\epsilon_{r1}$. Conversely the wavelength of the radiation is effectively lengthened upon entering the first medium from the second medium. For example a dielectric separator having a dielectric constant, relative permittivity, of 4 effectively shortens the wavelength of radiation by a factor of 2 relative to the wavelength of the radiation in air, or vacuum.

It is envisaged that the whole PAA could be embedded in a dielectric material and the separators may have a relative permittivity that is less than that of the embedding dielectric. This has the effect of the dielectric separators effectively reducing the electrical pathlength of the radiation between adjacent elements.

Referring now to FIG. 6, with reference to FIGS. 4 and 5, control of the dielectric constant, (relative permittivity), and thickness of the dielectric separator 408 allows the phase of IMC radiation exiting the dielectric separator 408 to be controlled. IMC radiation 602 incident upon dielectric separator 408, for example, having a dielectric constant $\epsilon_r$=4 and thickness d, has a wavelength in air, λ. Upon entry into the separator 408 the IMC radiation 602 has its wavelength halved to λ/2. Therefore, whereas in air the IMC radiation 602 will complete d/λ phase cycles in the distance d it will complete 2d/λ phase cycles in the separator 408. Thus, by tailoring the thickness of the separator the phase of the IMC radiation 603 emerging from the separator can be modified, typically to minimise the effect of IMC between the array elements 402, 404. Thus, a desired phase of IMC radiation incident upon the array element 404 due to the operation of the other array element 402 is achievable. A similar effect can be achieved by varying the dielectric constant of the separator 408 and indeed the two effects are complimentary to one another.

Referring now to FIG. 7 of the accompanying drawings, an alternate embodiment of a linear phased array antenna 700 having three elements shown. It comprises a central array element 702, two peripheral array elements 704, 706 and dielectric separators 708, 710 interposed between the central array element 702 and the respective peripheral array elements 704, 706.

Referring now to FIG. 8, this shows the embedded radiation patterns in the plane of the magnetic field vector (H), for each of the phased array antenna elements, with no dielectric separators present. Radiation patterns (Plots 802, 804) relating to the two peripheral array elements 704, 706 do not have their maximums centred on θ=0°. The central array element 702 exhibits a radiation pattern (Plot 806) with a maximum centred upon θ=0°. The two peripheral array elements 704, 706 have radiation patterns (Plots 802, 804) that are skewed away from θ=0. In the case with only the leftmost element 704 operating, IMC between the leftmost element 704 and the central element 702 plus the leftmost element 704 and the rightmost element 706 results in interference with the typical radiated field from the leftmost element. This in turn results in a skewed embedded radiation pattern (Plot 802). Similar arguments apply to the generations of the embedded radiation patterns (Plots 804,806) of the rightmost 706 and central array elements 702 respectively. The fact that the array is symmetrical about the central element 702 means that the resulting non-skewed embedded radiation pattern (Plot 806) for this element results from equal and opposite effects from both the rightmost 706 and leftmost 704 array elements.

It will be appreciated that if the two peripheral array elements 704, 706 are not symmetrically positioned about the central array element 702 the inequality of the IMC effects of each of the peripheral array elements 704, 706 with the central array element 702 may result in an embedded radiation pattern (Plot 806) for the central array element 702, that is also skewed away from θ=0°. It will also result in a reduction of symmetry between the embedded radiation patterns (Plots 802,804) of the peripheral array elements 704,706.

Referring now to FIG. 9. This shows the embedded radiation patterns (Plots 902-906) of array elements corresponding to those of FIG. 7 but including dielectric separators interposed between the central array element 702 and the respective peripheral array elements 704,706. In this example the dielectric separators have a width of 5 mm and a dielectric constant of $\epsilon_r$=9.3. A skewing of the embedded radiation patterns (Plots 902, 904) for the two peripheral array elements 704, 706 is evident. Due to symmetry the embedded radiation patterns (Plots 902,904) of the peripheral array elements 704, 706 are symmetrical and that the embedded radiation pattern (Plot 906) for the central array element 702 is distorted, but not skewed away from θ=0°. The embedded radiation patterns (Plots 902,904) for the two peripheral elements 704, 706 have in fact crossed over the θ=0° ordinate compared to the case shown in FIG. 8 even though the physical layout of the PAA remains the same.

Referring now to FIG. 10, embedded radiation patterns (Plots 1002-1006) are shown for a similar arrangement to that discussed with reference to FIG. 9 except that the dielectric separators have a dielectric constant of $\epsilon_r$=4.0 and a width of 5 mm. The embedded radiation patterns (Plots 1004, 1002) of the peripheral array elements 702, 706 are now seen to be not skewed away from θ=0°. Whilst the embedded radiation pattern (Plot 1006) for the central array element 702 remains distorted but not skewed. Thus, it can be seen that this arrangement corrects skewing and distortion of the embedded radiation patterns due to IMC discussed in relation to FIGS. 8 and 9.

This shows that the embedded radiation patterns of individual array elements can be manipulated by modifying the phase component of IMC between array elements using dielectric separators. This may lead to improvements in beam steering accuracy and a relaxation in design constraints in terms of array element spacings, grating lobes and operational FOR.

In all of the above cases the field vector whose direction is parallel to the dielectric separators, (E vector in this case) is unaffected in this example.

It will be appreciated that in the case of a two-dimensional phased array antenna each array element may be at least partially surrounded by a dielectric structure. This gives the designer of the antenna the ability to vary the thickness, profile and/or relative permitivitty of each face of the dielectric structure in order to compensate for mutual coupling of a given array element with more than one, inequivalent, neighbouring array elements of the array.

Referring now to FIG. 11, a phased array antenna 1100 comprises a two-dimensional array 1101 of array elements 1102*a-n* and dielectric separators 1104. A fraction of the array elements 1102*a-b*, typically those towards the centre of the antenna 1100, are completely surrounded by separators 1104. A further fraction of the array elements 1102*c-f* are partially surrounded by separators 1104 and these array elements 1102*c-f* are typically between an edge of the array 1102 and the centre of the array 1102. The array elements 1102*g-n* adjacent the edge of the array 1101 typically have discrete planar or accurate separators 1104 therebetween.

The effect of such an arrangement of separators 1104 is to allow a designer of the array 1101 to 'tune' the separators 1104 by varying the width and dielectric constant, of portions of the separators 1104 in order to optimise a reduction in mutual coupling between adjacent inequivalent array elements 1102*a-n*. This is of particular utility in high quality antennas such those used for radar, navigation and aerospace applications.

Referring now to FIG. 11*a*, an antenna 1110 comprises array elements 1112*a-c* separated by annular separators 1114*a-c*. The use of annular separators 1114*a-c* results in the suppression of the effect of IMC of both the H and E fields as the separators 1114*a-c* span alignment directions of the H and E fields where IMC is significant in both principal H and E vector planes.

Referring now to FIG. 11*c*, an antenna 1120 comprises array elements 1122*a-h* separated in a single direction by planar walls 1124*a-f*. In this arrangement the separators serve to reducing the effect of IMC coupling in only a single dimension, in this instance perpendicular to the direction of the separators 1124*a-f*.

Referring now to FIG. 11*c*, an antenna 1130 comprises array elements 1132*a-f* that are separated by intersecting mutually orthogonal vertical walls 1134*a-d*. This has the effect of reducing the effect of IMC in both the horizontal and vertical planes.

Alternatively, a simple grid of dielectric structures can be used to at least partially compensate for IMC between array elements of the array.

Referring now to FIG. 12, a phased array antenna 1200 comprises a two dimensional array 1201 of array elements 1202*a-i* arranged in a regular fashion, in this case a 3×3 square and a plurality of horizontally and vertically aligned dielectric separators 1204 between adjacent array elements 1202*a-i*. The separators 1204 take the form of discrete plain flat walls in this embodiment, although it will be appreciated that they may be of any convenient, appropriate, shape or configuration.

Typically, this arrangement allows for partial cancellation of mutual coupling between adjacent array elements 1202*a-i* without having to undertake a full design exercise in order to optimise for each array element 1202*a-i*. This is particularly useful in low cost mass produced antenna such as those used in wireless local area network (WLAN) applications.

In all cases it will be appreciated that any dielectric separator can be of any shape or form and of any dielectric constant. Also it will be appreciated that the purpose of imposing these dielectric separators between array elements is to provide the antenna designer with a method of manipulating the phase component of IMC between array elements. This is done so as to adjust the embedded radiation patterns of that array.

It will be appreciated that phased array antennas as described hereinbefore have a wide range of applications including navigation systems, particularly in aerospace applications, radar and communication systems such as wireless local area networks (WLAN), mobile telephone base stations, e.g. GSM, GPRS, UTMS, and satellite data links.

The invention claimed is:

1. A phased array antenna comprising a first array element and a second array element and a dielectric separator, the dielectric separator taking the form of a wall and being interposed between the first and second array elements within a path of an IMC signal between the first and second array elements, and wherein:

the dielectric separator has a combination of dielectric constant, profile and/or width that is determined in order to reduce the effect of mutual coupling between the first and second array elements;

the dielectric separator is arranged to increase or decrease the electrical path length between the first and second array elements;

the dielectric separator is arranged to control the phase component of the IMC signal so as to influence embedded radiation patterns of the first and second array elements;

wherein the dielectric separator is any one or combination of the following: a plain flat wall, an annular wall, a plurality of conjoined plane flat walls, profiled wall, a plurality of conjoined profiled walls; and wherein the array comprises at least one of a two-dimensional array, a linear array of array elements and a conformal array of array elements, and wherein:

all of the array elements are substantially in a single plane;

at least one of the first and second array elements is completely surrounded by a dielectric separator; and differing portions of the dielectric separator have different thicknesses and/or relative permitivitties.

2. A phased array antenna comprising a first array element and a second array element and a dielectric separator, the dielectric separator being interposed between the first and second array elements within a path of an Inter-element Mutual Coupling (IMC) signal between the first and second array elements, wherein the array comprises at least one of a two-dimensional array, a linear array of array elements and a conformal array of array elements, and wherein at least one of the first and second array elements is completely surrounded by a dielectric separator.

3. An antenna according to claim 2 wherein differing portions of the dielectric separator have different thicknesses and/or relative permitivitties.

4. A phased array antenna comprising a first array element and a second array element and a dielectric separator, the dielectric separator being interposed between the first and second array elements within a path of an Inter-element Mutual Coupling (IMC) signal between the first and second array elements, the array comprising at least one of a two-dimensional array, a linear array of array elements and a conformal array of array elements with a grid of dielectric separators interposed between the array elements.

5. A phased array antenna comprising a first array element and a second array element and a dielectric separator, the dielectric separator being interposed between the first and second array elements within a path of an Inter-element Mutual Coupling (IMC) signal between the first and second array elements, wherein the array comprises at least one of a two-dimensional array, a linear array of array elements and a conformal array of array elements, the array elements being arranged in a grid.

6. An antenna according to claim 5 wherein the dielectric separator has a combination of dielectric constant, profile and/or width that is determined in order to reduce the effect of mutual coupling between the first and second array elements.

7. An antenna according to claim 5 wherein the dielectric separator is arranged to increase or decrease the electrical path length between the first and second array elements.

8. An antenna according to claim 5 wherein the dielectric separator is arranged to control the phase component of the IMC signal so as to influence embedded radiation patterns of the first and second array elements.

9. An antenna according to claim 5 wherein the dielectric separator is any one or combination of the following: a plain flat wall, an annular wall, a plurality of conjoined plane flat walls, profiled wall, a plurality of conjoined profiled walls.

10. An antenna according to claim 5 wherein the dielectric separator has a dielectric constant of between 3 and 12.

11. An antenna according to claim 5 wherein the array comprises at least one of a two-dimensional array, a linear array of array elements and a conformal array of array elements.

12. An antenna according to claim 11 wherein all of the array elements are substantially in a single plane.

13. An antenna according to claim 5 wherein each array element is separated from at least one neighbouring array element by a respective dielectric separator.

14. An antenna according to claim 13 wherein the respective dielectric separators are be discrete or are formed as a part of a larger, continuous grid of dielectric with the array elements located in spaces bounded by regions of the grid.

* * * * *